United States Patent [19]

Navarro

[11] Patent Number: 4,561,490

[45] Date of Patent: Dec. 31, 1985

[54] METHOD OF, AND APPARATUS FOR, CONTINUOUSLY CASTING A CURVED STRAND USING A CURVED RIGID DUMMY BAR

[75] Inventor: Carlos R. Navarro, Barcelona, Spain

[73] Assignee: Concast Service Union AG, Zurich, Switzerland

[21] Appl. No.: 510,964

[22] Filed: Jul. 5, 1983

[30] Foreign Application Priority Data

Jul. 16, 1982 [CH] Switzerland ..... 4342/82

[51] Int. Cl.[4] ..... B22D 11/08

[52] U.S. Cl. ..... 164/483; 164/426

[58] Field of Search ..... 164/483, 426, 446, 425, 164/445

[56] References Cited

U.S. PATENT DOCUMENTS

| | | | |
|---|---|---|---|
| 3,080,625 | 2/1959 | Pearson | 164/425 |
| 3,344,844 | 8/1964 | Reinfeld | 164/426 |
| 4,291,748 | 9/1981 | Langer | 164/426 |

FOREIGN PATENT DOCUMENTS

| | | | |
|---|---|---|---|
| 923731 | 4/1982 | U.S.S.R. | 164/426 |

*Primary Examiner*—Nicholas P. Godici
*Assistant Examiner*—G. M. Reid
*Attorney, Agent, or Firm*—Werner W. Kleeman

[57] ABSTRACT

In a curved or arc-type continuous casting installation provided with a curved or arc-type rigid dummy bar the curved dummy bar is separated from the cast strand at the region of the straightener by means of a movable roller. To improve the economy and to increase the decoupling reliability the dummy bar head is provided with a permanent coupling member which is disengageable from the cast strand by performing a pivoting movement. Furthermore, the dummy bar head is pivotably connected or linked to the dummy bar so as to be pivotable about an axis extending transversely with respect to the strand moving direction. For disengagement of the dummy bar head from the cast strand the movable roller presses upon the pivotable dummy bar head so that the same, during the casting operation, is pivoted outwardly out of its axial position away from the curved longitudinal axis of the curved dummy bar.

8 Claims, 4 Drawing Figures

METHOD OF, AND APPARATUS FOR, CONTINUOUSLY CASTING A CURVED STRAND USING A CURVED RIGID DUMMY BAR

BACKGROUND OF THE INVENTION

The present invention broadly relates to a new and improved method of, and apparatus for, continuously casting a strand using a curved rigid dummy bar.

In its more specific aspects the invention relates to a new and improved method of, and apparatus for, continuously casting a curved strand using a curved rigid dummy bar, wherein the cast strand is separated from the dummy bar at the region of the straightener or straightening machine by a roller which is movable towards the strand track or path of travel of the strand such that the position of the longitudinal axis of the moving rigid dummy bar is retained.

For the start-up of a continuous casting installation a dummy bar or starting bar is required. The dummy bar head is provided with a coupling member and closes the continuous casting mold at its underside. When the casting operation is started, the dummy bar head produces a connection with the cast strand, so that the cast strand can be withdrawn from the continuous casting mold and introduced into the withdrawal unit.

The dummy bar in curved continuous casting installations may be, for example, composed of individual members or may be constituted by other flexible constructions. Also, the dummy bar may comprise a rigid curved or arcuate piece of steel, generally having the length of approximately a quadrant.

The use of a curved or arcuate rigid dummy bar or starting bar in an arc-type or curved continuous casting installation is known, for example, from U.S. Pat. No. 3,344,844, granted Oct. 3, 1967, wherein the dummy bar is provided with a releasable dummy bar head. The coupling element or member of the dummy bar head comprises an insertable bolt about which liquid steel is cast during the start of the casting operation. The dummy bar head itself is provided with a second coupling element permitting the dummy bar head to be coupled to the dummy bar. At the region of the straightener or straightening machine of this continuous casting installation there is arranged a roller which is movable towards the strand track or path of travel for the cast strand. For separating the cast strand from the dummy bar the movable roller presses upon the cast strand, and thus, disengages the coupling between the dummy bar head and the dummy bar. During such disengagement or decoupling operation the dummy bar moves along its longitudinal axis and remains at its path of movement. The dummy bar head connected to the cast strand passes through shears. The dummy bar head is first separated from the crop end only after the crop-end cut and then is supplied for re-use. Another bolt has to be inserted into the dummy bar head which serves as a coupling element for the next following casting operation or pour.

This state-of-the-art curved continuous casting installation is afflicted with various disadvantages. The dummy bar head remaining at the crop end, which must be manually separated after each casting operation or pour, has to be provided with a new coupling element or member prior to each re-use, has to be recoupled to the dummy bar and has to be protected from or secured against dropping-off. All of these operations or procedures are associated with additional costs. Furthermore, the crop end cannot be faultlessly aligned or straightened in such a casting installation even in the presence of a precise switching pulse for applying the movable press roller at the cast strand, because the strand does not rest upon the straight roller apron or bed during the time of the drive-out or press-out operation. Imprecisely aligned or straightened crop ends at the cast strand, however, frequently cause disturbances when entering a successive shear arrangement.

In a further prior art curved continuous casting installation as known, for example, from U.S. Pat. No. 4,291,748, granted Sept. 29, 1981, a dummy bar contains a rigid portion or member and an articulated flexible portion or member. The rigid member and the flexible member each have a length of approximately half the circular-shaped strand guide or roller apron. The dummy bar head of this dummy bar is provided with a permanent coupling element or member, and the disengagement or decoupling operation is effected by relative movement of the cast strand and the dummy bar head in a direction transverse to the longitudinal axis of the strand. Although approximately only one-half of such a dummy bar is rigid, such construction of dummy bar satisfies two essential requirements for the group of rigid dummy bars. The disengagement or decoupling between the cast strand and the dummy bar is performed at the non-straightened hot strand and the rigid portion or member of the dummy bar bridges larger sections of the secondary cooling zone below the mold and in which sections the strand is not guided. Considering its function, this type of dummy bar which is rigid over half of its length thus can be associated with the group of rigid dummy bars. However, even in such installations the crop end of the cast strand cannot be faultlessly straightened during the time interval of the disengaging or decoupling operation. Depending upon the force required for separating the cast coupling element or member from the dummy bar head the dummy bar may experience a permanent deformation, resulting in difficulties during reinsertion of the dummy bar into the continuous casting mold.

SUMMARY OF THE INVENTION

Therefore, with the foregoing in mind it is a primary object of the present invention to provide a new and improved method of, and apparatus for, continuously casting a strand using a curved rigid dummy bar or starting bar in which permanent coupling means are used and in which there is ensured for faultless disengagement of the permanent coupling portion or member from the cast strand.

Another important object of the present invention is directed to the provision of a new and improved method of, and apparatus for, continuously casting a strand using a curved rigid dummy bar in which there is positively avoided deformation of the rigid dummy bar during disengagement or decoupling thereof from the cast strand.

Still a further significant object of the present invention is directed to a new and improved method of, and apparatus for, continuously casting a strand using a curved rigid dummy bar in which the disengagement of the cast strand from the dummy bar is not impaired even in the presence of high casting velocities and large changes in the casting velocity of the strand due to the use of non-regulatable pouring nozzles or the like at the tundish.

Another important object of the present invention is directed to a new and improved method of, and apparatus for, continuously casting a strand using a curved rigid dummy bar in which there is ensured faultless straightening of the head of the cast strand in order to enable precise introduction of the same into a successively arranged shear arrangement.

Now in order to implement these and still further objects of the invention, which will become more readily apparent as the description proceeds, the continuous casting installation of the present development is manifested by the features that, at the dummy bar there is a dummy bar head provided with a permanent coupling element or member releasable by performing a pivoting movement about an axis extending transversely with respect to the strand moving or travel direction, and the engageable or movable roller exerts the force upon the pivotable dummy bar head needed for disengaging the permanent coupling element or member such that the dummy bar head is outwardly pivoted out of its axial position away from the curved longitudinal axis of the dummy bar during the casting operation.

As alluded to above, the present invention is not only concerned with the aforementioned apparatus aspects, but also relates to a novel method of operating such apparatus. Generally speaking, the inventive method entails separating the dummy bar as it moves in the strand withdrawal direction at the region of the straightener or straightening machine from the cast strand by using a roller which is movable towards or can be applied in the direction of the strand track or path of travel of the cast strand.

According to the invention, the inventive method, while using a curved rigid dummy bar, in its more specific aspects, comprises the steps of:

applying the pressing force of the movable or engageable roller to a dummy bar head containing a permanent coupling portion or member;

pivoting the dummy bar head outwardly away from the curved longitudinal axis of the dummy bar in order to directly disengage or decouple the same from the cast strand; and repivoting the disengaged dummy bar head in a direction towards the longitudinal axis of the dummy bar during further movement of the dummy bar.

By using a permanent dummy bar head all additional complications and costs can be avoided in comparison to the use of non-permanent dummy bar heads. Furthermore, the inventive arrangement reduces the bending forces acting upon the rigid dummy bar by virtue of the pivoting movement of the dummy bar head carried out during the decoupling operation, which serves to precisely retain its dimensional shape and also results in an increased precision of the introduction of the dummy bar head into the continuous casting mold. Additionally, the travel distances covered during the decoupling or disengaging operation and caused by different casting velocities can be eliminated to a large extent as disturbing factors. Also, the straightening operation can start before the movable or engageable roller presses against the cast strand. The decoupling operation has taken place when the hot cast strand arrives at the region of the movable or engageable roller which thus only has to fulfill the function of a straightening roller. There is thus realized a faultless straightening of the starting end of the cast strand which ensures for a disturbance-free entry of the cast strand into the narrowly adjusted shearing cutters of a successively arranged shear arrangement. In practice it has been furthermore found that the pivotable dummy bar head also facilitates introduction thereof into the mold when, after longer operating or working times, the guiding precision of the dummy bar by the action of the drive rolls has been reduced due to natural wear phenomenon. Even under such circumstances the pivotable dummy bar head can be introduced into the mold without any disturbances.

After disengagement or decoupling of the dummy bar head from the cast strand the pivotable dummy bar head can be manually pivoted back into its original or starting position and can be secured in such starting position by shear pins which can be sheared-off under the action of small forces.

In accordance with a further feature of the apparatus according to the invention a device or means is operatively associated with the dummy bar head for automatically repivoting the same into a position which is in alignment with the curved longitudinal or lengthwise axis of the rigid dummy bar. Such automatic repivoting means or device may for example, comprise a counterweight secured to the dummy bar head. Another advantageous design F automatic repivoting means for the tilted dummy bar head comprises a deflection roller arranged at the inlet or entry side of a dummy bar receiving casing or cartridge and a resilient locking or latching element arranged between the dummy bar head and the dummy bar. Both variant solutions of such repivoting means ensure for an axial positioning of the pivotable dummy bar head during introduction of the dummy bar into the strand guiding means or roller apron and into the flow-through or continuous casting mold.

The advance or lead time for the decoupling or disengaging operation of the dummy bar head from the cast strand by means of the movable or engageable roller can be influenced by the selection of the length of the outwardly pivotable dummy bar head portion or member. It is thus of particular advantage if the dummy bar head member, which is outwardly pivotable away from the curved longitudinal axis of the dummy bar, has a length of at least 300 mm.

In continuous casting installations or plants in which the lateral guidance of the rigid dummy bar has become imprecise, for example, due to wear, it can be of advantage if the dummy bar head is arranged for limited movement about a plane which extends normally or perpendicular with respect to the pivoting plane. However, the advantages of a dummy bar head which is connected for movement in two pivoting planes or in two mutually normal displacement planes can be additionally utilized when the dummy bar head, during the inserting movement into the mold, is provided with a conical removable centering member.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
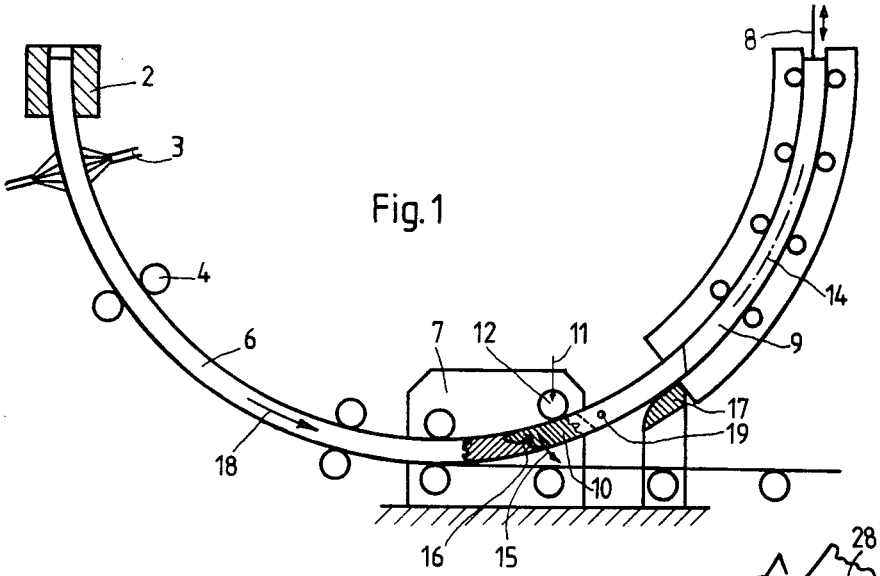
FIG. 1 is a schematic side view of a curved or arc-type continuous casting installation according to the invention.

Describing now the drawings, it is to be understood that only enough of the construction of the curved or arc-type continuous casting installation has been shown as needed for those skilled in the art to readily understand the underlying principles and concepts of the present development while simplifying the showing of the drawings. Turning attention now specifically to FIG. 1, there has been schematically illustrated therein a continuous casting or flow-through mold 2 of a curved continuous casting installation, preferably for producing steel billets. Secondary cooling means have been conveniently indicated by the spray nozzles 3. A small number of guiding or guide rollers 4 guide the cast strand or casting 6 along the curved strand guiding means or roller apron towards and into a withdrawal and straightening unit or machine 7. A rigid dummy bar or starting bar 9 can be moved, for example, by a cable 8 and contains a dummy bar head 10. In the illustration of FIG. 1 the dummy bar head 10 has arrived at a decoupling or disengaging position. An engageable or movable roller 12 which is conveniently mounted for movement towards the strand track or path of travel, in the direction of the arrow 11, starts to separate or disconnect the cast strand 6 from the dummy bar head 10 in the illustrated position. The dummy bar 9 moves along its curved longitudinal or lengthwise axis 14 during the decoupling or disengaging operation.

The dummy bar head 10 may be decoupled or disengaged from the cast strand 6 by performing a pivoting movement in the direction of the arrow 15. In the embodiment shown in FIG. 1 a curved hollow space is provided in the end wall of the dummy bar head 10 and forms a coupling portion or member 16. At the start of the casting operation a corresponding coupling hook formed by the cast metal solidifies in this hollow space constituting the coupling portion or member 16. The dummy bar head 10 is articulated to the rigid dummy bar 9 and pivotable about a pivot axis 19 which extends transversely with respect to the strand moving or travel direction 18. To disengage the dummy bar head 10 from the cast strand 6 the movable or engageable decoupling roller 12 presses upon the dummy bar head 10 in the direction of the arrow 11, and thus, pivots the same outwardly away from the curved longitudinal axis 14 of the dummy bar 9. The dummy bar 9 is supported by a bearing block 17 which may be arranged adjacent the roller 12 in order to avoid deformations or undesired bending of the dummy bar 9.

Figure 2:
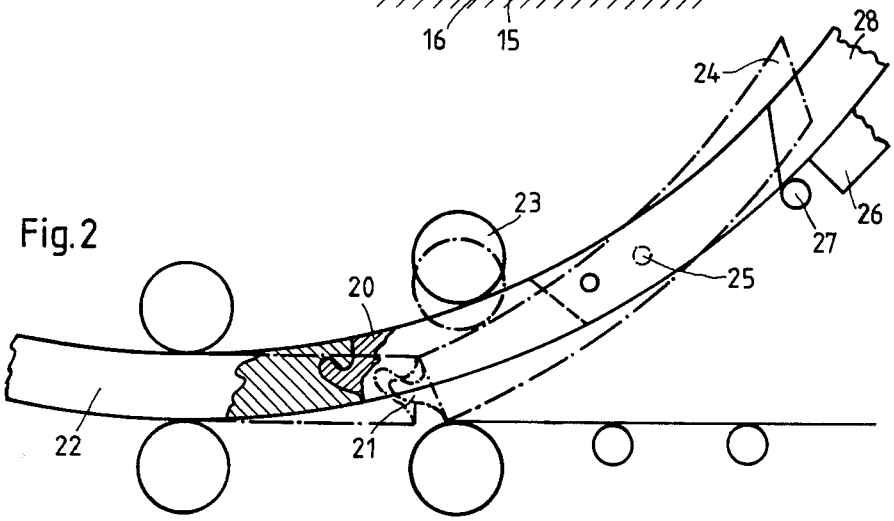
FIG. 2 is a schematic side view of a withdrawal and straightening unit or machine used in the continuous casting installation shown in FIG. 1.

In the arrangement of FIG. 2 a dummy bar head is designated by reference numeral 20 and comprises a coupling member 21 which has the shape of a bent finger. By means of the solid lines there has been illustrated the situation immediately prior to the start of the separating or decoupling operation and the dash-dotted or phantom lines illustrate the situation during the separating or decoupling operation. An engageable or movable roller 23 presses upon the moving dummy bar head 20. Consequently, the engageable or movable decoupling roller 23 first disengages the cast coupling member 21, then disconnects or separates the dummy bar head 20 from the cast strand 22 and begins, during the decoupling or separating operation and prior to contacting the cast strand 22, to urge and straighten the cast strand 22 into the substantially horizontal position. The dummy bar head 20 is provided with a counterweight 24 in order to automatically repivot the same, after the completed disengagment or decoupling operation, into an aligned position with respect to the longitudinal axis of the dummy bar 28. The counterweight 24, which generates a repivoting movement about a pivot axis 25, fixedly retains the dummy bar head 20 of the rigid dummy bar 28 in its axial position also during the introduction movement thereof into the mold. A receiving casing or cartridge for the dummy bar 28 is indicated by reference numeral 26 and a roller 27 is arranged forwardly thereof.

Figure 3:
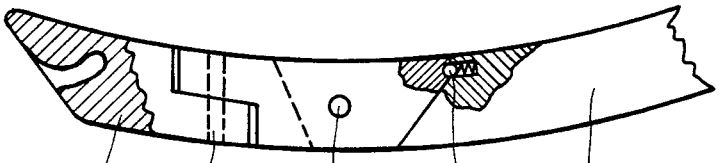
FIG. 3 is a side view of a modified construction of dummy bar head for use in the continuous casting installation as shown in FIG. 1.
Figure 4:
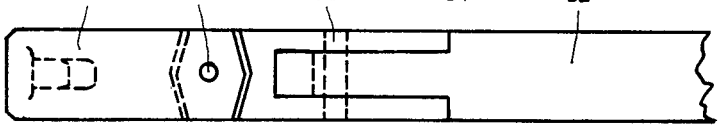
FIG. 4 is a top plan view of the modified dummy bar head shown in FIG. 3.

An alternative construction of repivoting means or device in contrast to the previously described counterweight 24 shown in FIG. 2, has been illustrated in FIGS. 3 and 4. Accordingly, here a resilient locking element 31 forming a spring-loaded ball is shown arranged intermediate a dummy bar head 30 and a dummy bar 32. To repivot the dummy bar head 30 from its pivoted position back into the axial position during retraction or return travel back into the dummy bar casing 26, the roller 27 (FIG. 2) arranged at the inlet or entry side of the dummy bar casing 26 (FIG. 2) takes over the task of performing such repivoting movement. In case that a limited universal mobility of the dummy bar head 30 is desired for introducing the same into the mold 2, then the dummy bar head 30 may be arranged in a pivoting plane defined by an axis 33 or a plane containing such pivot axis 33, on the one hand, and is movable to a limited extent in a plane extending normally with respect to the pivoting plane, on the other hand. Such additional mobility is rendered possible in the illustrated exemplary modification by the provision of the pivot axis 34. However, such mobility also can be obtained by any other suitable means. To introduce such a dummy bar head 30 into the flow-through mold 2 it is advantageous if a conical centering portion or member, which is removable after the introduction, is mounted upon the coupling member.

Instead of the constructions of dummy bar heads as described hereinbefore with reference to specific exemplary embodiments other permanent coupling means may be used and which can be disengaged or decoupled by performing appropriate pivoting or tilting movements.

The continuous casting installation constructed according to the invention may be also advantageously utilized for producing blooms.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A curved continuous casting installation for casting strands, comprising:

means defining a strand path of travel for a cast strand moving in a predetermined direction of travel;

a curved rigid dummy bar having a curved longitudinally axis;

a dummy bar head articulated to said dummy bar;

said summy bar head being articulated to said dummy bar for performing a pivotal movement about an axis extending transversely with respect to said predetermined direction of travel of the cast strand;

said dummy bar head being provided with a permanent coupling member disengageable from the cast strand by performing said pivoting movement of the dummy bar head;

a straightener machine;

an engageable decoupling roller arranged at the region of said straightener machine;

said engagable decoupling roller being movable towards said pivotable dummy bar head to act upon the same with a force sufficient to disengage said permanent coupling member from said cast strand such that during the casting operation said dummy bar head is pivoted outwardly from an axial position thereof with respect to the dummy bar and away from said curved longitudinal axis of said dummy; and said force with which said engageable decoupling roller acts upon said pivotable dummy bar head being adapted to initiate a straightening operation for the cast strand before said engageable decoupling roller engages the cast strand.

2. The curved continuous casting installation as defined in claim 1, further including:

repivoting means for automatically repivoting said outwardly pivoted dummy bar head into a position which is essentially aligned with said curved longitudinal axis of said dummy bar.

3. The curved continuous casting installation as defined in claim 2, wherein:

said repivoting means comprises a counterweight secured to said dummy bar head.

4. A curved continuous casting installation for casting strands, comprising:

means defining a strand path of travel for a cast strand moving in a predetermined direction of travel;

a curved rigid dummy bar having a curved longitudinal axis;

a dummy bar head articulated to said dummy bar;

said dummy bar head being articulated to said dummy bar for performing a pivotal movement about an axis extending transversely with respect to said predetermined direction of travel of the cast strand;

said dummy bar head being provided with a permanent coupling member disengageable from the cast strand by performing said pivoting movement of the dummy bar head;

a straightener machine;

a engageable decoupling roller arranged at the region of said straightener machine;

said engageable decoupling roller being movable towards said pivotable dummy bar head in order to act upon the same with a force sufficient to disengage said permanent coupling member from said cast strand such that during the casting operation said dummy bar head is pivoted outwardly from an axial position thereof with respect to the dummy bar and away from said curved longitudinal axis of said dummy bar;

repivoting means for automatically repivoting said outwardly pivoted dummy bar head into a position which is essentially aligned with said curved longitudinal axis of said dummy bar;

a dummy bar receiving casing having an input side; and said repivoting means comprising a deflection roller arranged at said input side and a resilient locking element arranged intermediate said dummy bar head and said dummy bar.

5. The curved continuous casting installation as defined in claim 1, wherein:

said dummy bar head which is pivotable outwardly away from said curved longitudinal axis of the dummy bar possesses a length of at least 300 mm.

6. The curved continuous casting installation as defined in claim 1, further including:

means for mounting said dummy bar head for limited pivotable movement about a plane extending substantially perpendicular to a pivot plane defined by said outwardly directed pivoting movement of said dummy bar head.

7. A method of continuously casting a strand using a curved continuous casting installation equipped with a curved rigid dummy bar possessing a curved longitudinal axis, a dummy bar head articulated to said dummy bar and provided with a permanent coupling member, a straightener machine and a decoupling roller at the vincinity of said straightener machine, said method comprising the steps of:

moving said dummy bar in a predetermined strand withdrawal direction along a strand path of travel so as to pass said straightener machine;

moving said decoupling roller towards said strand path of travel;

bringing said decoupling roller into contact with said dummy bar head so as to act upon said dummy bar head with a force sufficient to pivot said dummy bar head outwardly from said curved longitudinal axis thereof in order to initiate a straigthening operation for the cast strand and to subsequently immediately disengage said dummy bar head from the cast strand;

applying a straightening force to the dummy bar head, before a decoupling, to incorporate a straightening operation for the cast strand; and repivoting said disengaged dummy bar head in the direction of said curved longitudinal axis of the dummy bar during further movement of said dummy bar.

8. The method as defined in claim 7, further including the steps of:

using a dummy bar head having a permanent coupling element which remains fixed at the dummy bar head.

* * * * *

UNITED STATES PATENT AND TRADEMARK OFFICE

CERTIFICATE OF CORRECTION

PATENT NO. : 4,561,490

DATED : December 31, 1985

INVENTOR(S) : CARLOS ROS NAVARRO

It is certified that error appears in the above—identified patent and that said Letters Patent is hereby corrected as shown below:

Column 4, line 24, please delete "F" and insert --of--

Signed and Sealed this

*Fifteenth* Day of *April 1986*

[SEAL]

*Attest:*

DONALD J. QUIGG

*Attesting Officer*

*Commissioner of Patents and Trademarks*